United States Patent [19]

Arriola

[11] 4,061,065

[45] Dec. 6, 1977

[54] CARPET CUTTING DEVICE

[75] Inventor: Baltazar Arriola, Montebello, Calif.

[73] Assignee: The Raymond Lee Organization, Inc., New York, N.Y. ; a part interest

[21] Appl. No.: 724,297

[22] Filed: Sept. 20, 1976

[51] Int. Cl.[2] ..... B26D 5/08

[52] U.S. Cl. ..... 83/562; 83/686; 83/928

[58] Field of Search ..... 83/562, 561, 928, 686

[56] References Cited

U.S. PATENT DOCUMENTS

| | | | |
|---|---|---|---|
| 937,460 | 10/1909 | Myers | 83/562 |
| 2,783,789 | 3/1957 | Konway | 83/928 |
| 3,062,083 | 11/1962 | Strnad | 83/686 |
| 3,788,179 | 1/1974 | Vallier | 83/562 |

*Primary Examiner*—Donald R. Schran
*Attorney, Agent, or Firm*—Daniel Jay Tick

[57] ABSTRACT

A base member has spaced opposite first and second parallel surfaces. A support member is mounted on the base member in spaced parallel relation with the first surface of the base member in a manner whereby a carpet is passable between the base and support members. A carriage is movably mounted on the support member and manually controllable for positioning at a desired point on the support member. A punch device is mounted on the carriage and includes a cutting member of predetermined shape and dimensions for forcing the cutting member into the carpet with sufficient force to cut out a piece of the carpet of the predetermined shape and dimensions.

3 Claims, 5 Drawing Figures

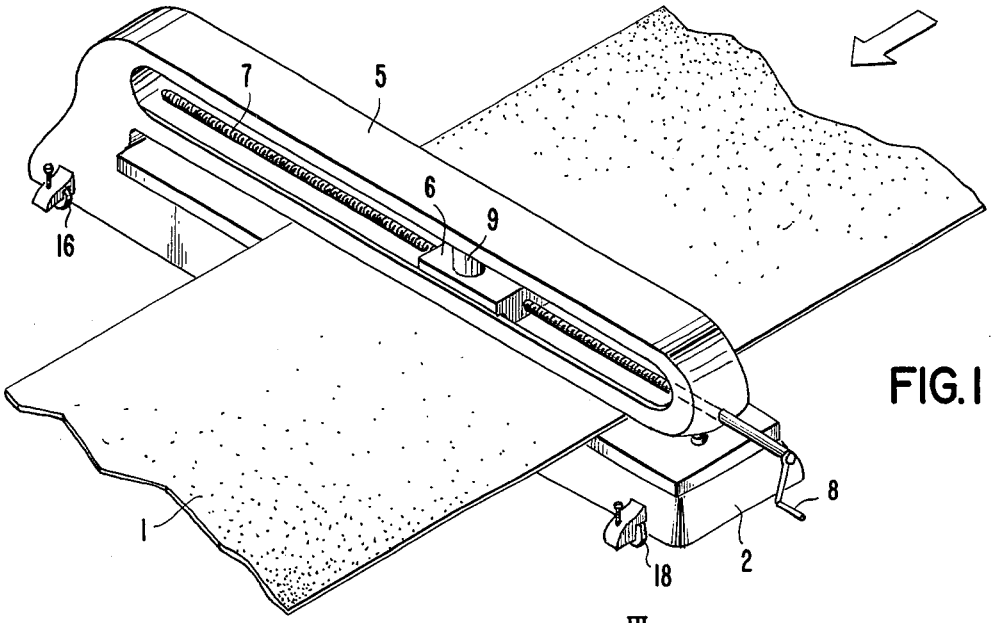
FIG. 1
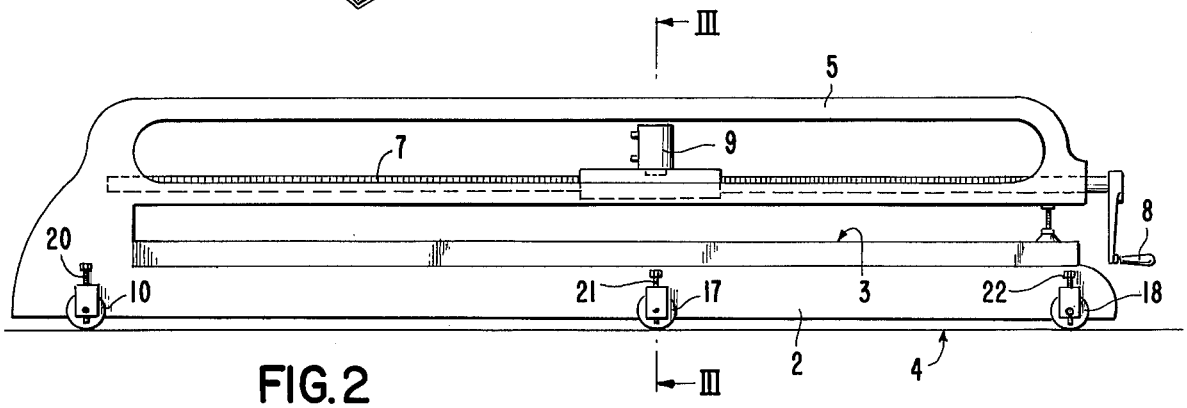
FIG. 2
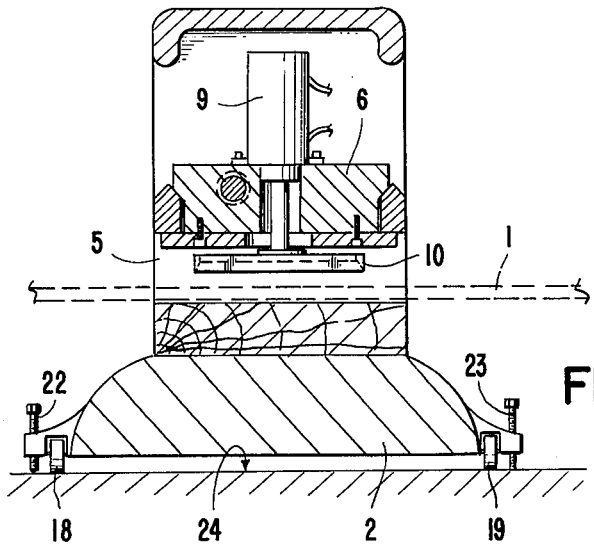
FIG. 3
FIG. 4
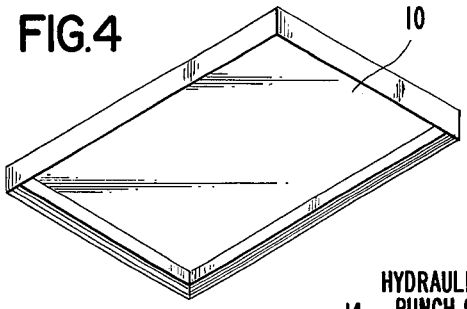
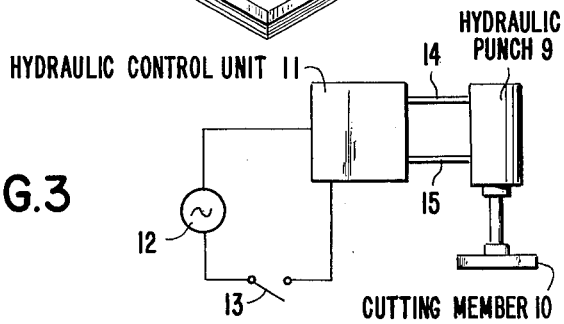
FIG. 5

CARPET CUTTING DEVICE

BACKGROUND OF THE INVENTION

The present invention relates to a carpet cutting device. More particularly, the invention relates to a carpet cutting device for cutting a piece of carpet of predetermined shape and dimensions from a larger piece of carpet.

Objects of the invention are to provide a carpet cutting device of simple structure, which is inexpensive in manufacture, used with facility and convenience, safe in use, and functions efficiently, effectively and reliably to cut a piece of carpet of predetermined shape and dimensions from a larger piece of carpet thereby enabling the larger piece of carpet to be patched in a professional manner wherein the patch is hardly noticeable.

BRIEF DESCRIPTION OF THE DRAWINGS

In order that the invention may be readily carried into effect, it will now be described with reference to the accompanying drawings, wherein:

FIG. 1 is a perspective view of an embodiment of the carpet cutting device of the invention in use;

FIG. 2 is a side view of the embodiment of FIG. 1;

FIG. 3 is a view, on an enlarged scale, partly in section, taken along the lines III—III, of FIG. 2;

FIG. 4 is a perspective view, on an enlarged scale, of an embodiment of the cutting edge of the cutting member of the carpet cutting device of the invention; and FIG. 5 is a schematic diagram of the hydraulic system of the carpet cutting device of the invention.

DETAILED DESCRIPTION OF THE INVENTION

The carpet cutting device of the invention is for cutting a piece of carpet of predetermined shape and dimensions from a larger piece of carpet 1 (FIG. 1).

The carpet cutting device of the invention comprises a base member 2 (FIGS. 1 to 3) having spaced opposite first and second substantially parallel surfaces 3 and 4 (FIG. 2).

A support member 5 (FIGS. 1 to 3) is mounted on the base member 2 in spaced substantially parallel relation with the first surface 3 of the base member 2 in a manner whereby the carpet 1 is passable between the base and support members, as shown in FIGS. 1 and 3.

A carriage 6 (FIGS. 1 to 3) is movably mounted on the support member 5 and is manually controllable for positioning at a desired point on the support member. More particularly, the carriage 6 is movable along the length of the support member 5 by being threadedly affixed to an elongated externally threaded shaft 7 which extends along the length of said support member. A handle 8 at one end of the shaft 7 (FIGS. 1 and 2) is utilized to manually rotate the shaft about its axis, and in so doing, moves the carriage 6 linearly along said shaft.

A punch device 9 (FIGS. 1 to 3 and 5), which is preferably a hydraulic punch of any suitable known type, is mounted on the carriage 6 and includes a cutting member 10 (FIGS. 3 to 5) of a predetermined shape and dimensions. The punch device 9 forces the cutting member 10 into the carpet with sufficient force to cut out a piece of carpet of the predetermined shape and dimensions. Although the configuration of the cutting edge of the cutting member is that of a rectangle, which is most commonly utilized, a circle, or any other suitable configuration may, of course, be utilized.

The hydraulic punch 9 is controlled by any suitable hydraulic system such as, for example, a hydraulic control unit 11, as shown in FIG. 5, which is controlled by any suitable source of electrical energy 12 via an electric switch 13. The hydraulic control unit 11 is coupled to the hydraulic punch 9 via a supply duct 14 for supplying sufficient hydraulic fluid for operating the hydraulic punch to cut out a piece of carpet and a return duct 15 for returning the cutting member to its rest position. The hydraulic control unit 11 includes a hydraulic reservoir and valves for controlling the supply of hydraulic fluid to the hydraulic punch.

A plurality of wheels 16, 17, 18, 19 (FIGS. 2 and 3) and an additional two wheels, not shown in the FIGS., are swivelly mounted on the second surface 4 of the base member 2 for imparting mobility to the carpet cutting device. A plurality of pins 20, 21, 22, 23 (FIGS. 2 and 3) and an additional two pins, not shown in the FIGS., are movably affixed to the base member 2 for selectively raising the base member above a supporting surface 24 (FIGS. 2 and 3).

In operation, when a worn, torn, or holed part of the carpet 1 is discovered, the carpet cutting device of the invention is utilized to cut out the area involving the damaged part. The carpet cutting device is then used to cut a part of a carpet in good condition of the same dimensions and configuration as the damaged part removed from the carpet 1. The good piece of carpet then replaces the removed worn or damaged piece of carpet and is sealed into position by any suitable cement, adhesive, glue, or the like.

While the invention has been described by means of a specific example and in a specific embodiment, I do not wish to be limited thereto, for obvious modifications will occur to those skilled in the art without departing from the spirit and scope of the invention.

I claim:

1. A carpet cutting device for cutting a piece of carpet of predetermined shape and dimensions from a larger piece of carpet, said carpet cutting device comprising an elongated base member having spaced opposite first and second substantially parallel surfaces;

a single elongated support member mounted on the base member in spaced substantially parallel relation with the first surface of the base member in a manner whereby a carpet is passable between the base and support members, said support member having an elongated externally threaded shaft extending along the length thereof;

carriage means threadedly coupled to the shaft of the support member and manually controllable by rotation of said shaft about its axis for positioning at a desired point on the support member; and punch means mounted on the carriage means and including a cutting member of a predetermined shape and dimensions for forcing the cutting member into the carpet with sufficient force to cut out a piece of carpet of the predetermined shape and dimensions.

2. A carpet cutting device as claimed in claim 1, wherein the cutting member has a cutting edge of rectangular configuration.

3. A carpet cutting device as claimed in claim 1, further comprising a plurality of wheels swivelly mounted on the second surface of the base member for imparting mobility thereto, a plurality of projections each extending from the base member at a corresponding one of the wheels, and a plurality of pins each movably affixed in a corresponding one of the projections of said base member for selectively raising said base member above a supporting surface.

* * * * *